US011913311B2

(12) United States Patent
Fitzhugh et al.

(10) Patent No.: US 11,913,311 B2
(45) Date of Patent: Feb. 27, 2024

(54) FLOW CONTROL SHUTTLE

(71) Applicant: Advanced Oil Tools, LLC, Brady, TX (US)

(72) Inventors: Bryan Samuel Fitzhugh, Colleyville, TX (US); Timothy Wayne Raley, Hickory, NC (US); Jonathan Charles Birk, Hickory, NC (US)

(73) Assignee: ADVANCED OIL TOOLS, LLC, Brady, TX (US)

( * ) Notice: Subject to any disclaimer, the term of this patent is extended or adjusted under 35 U.S.C. 154(b) by 0 days.

(21) Appl. No.: 17/362,067

(22) Filed: Jun. 29, 2021

(65) Prior Publication Data

US 2021/0404300 A1 Dec. 30, 2021

Related U.S. Application Data

(60) Provisional application No. 63/046,572, filed on Jun. 30, 2020.

(51) Int. Cl.
*E21B 43/12* (2006.01)
*E21B 33/12* (2006.01)
*E21B 33/13* (2006.01)

(52) U.S. Cl.
CPC ..... *E21B 43/12* (2013.01); *E21B 33/12* (2013.01); *E21B 33/13* (2013.01)

(58) Field of Classification Search
CPC ..... E21B 43/12; E21B 33/12; E21B 33/13; E21B 33/128; E21B 33/1292; E21B 34/103
See application file for complete search history.

(56) References Cited

U.S. PATENT DOCUMENTS 3,790,037 A * 2/1974 Fletcher ..... G01F 11/021 222/444
4,427,070 A * 1/1984 O'Brien ..... E21B 34/14 166/317

(Continued)

FOREIGN PATENT DOCUMENTS

CA 2445870 C * 4/2009 ..... E21B 21/103

OTHER PUBLICATIONS

PCTUS2139562,Outgoing_Written_Opinion_of_the_International_Searching_Authority_(ISA),dated Nov. 12, 2021 (Year: 2021).*

*Primary Examiner* — Steven A MacDonald
(74) *Attorney, Agent, or Firm* — Kilpatrick Townsend & Stockton, LLP

(57) ABSTRACT

A flow control shuttle to provide the ability to block flow in either direction initially, while allowing a high-pressure differential capacity in one direction and does not produce free floating pieces of the plug in the flow stream after actuation. The mechanism is actuated by a pressure differential opposite the high-pressure direction, in which the actuation pressure can be set independently of the pressure rating of the high-pressure direction. Upon actuation the flow path opens allowing flow in either direction by moving a shuttle plug from a sealed to an unsealed configuration. The direction of high pressure and actuation pressure can be chosen by direction of installation on based what is required for the application. This mechanism can be incorporated into an existing tool or a new tool design, or can be provided as a standalone tool.

10 Claims, 10 Drawing Sheets

(56) References Cited

U.S. PATENT DOCUMENTS

| | | | | | |
|---|---|---|---|---|---|
| 4,610,465 | A * | 9/1986 | Boyadjieff | E02D 5/523 | 285/308 |
| 4,856,756 | A * | 8/1989 | Combs | F16K 3/26 | 166/332.6 |
| 5,095,978 | A * | 3/1992 | Akkerman | E21B 23/06 | 166/134 |
| 10,156,122 | B2 * | 12/2018 | Nguyen | E21B 34/00 | |
| 2004/0163820 | A1 * | 8/2004 | Bishop | E21B 34/06 | 166/373 |
| 2004/0238175 | A1 * | 12/2004 | Wade | E21B 33/043 | 166/368 |
| 2014/0251613 | A1 * | 9/2014 | Hill, Jr. | E21B 34/06 | 166/373 |
| 2016/0356133 | A1 * | 12/2016 | Hamid | E21B 34/10 | |
| 2017/0268327 | A1 * | 9/2017 | Eiman | E21B 43/04 | |
| 2019/0330958 | A1 * | 10/2019 | Prather | F16K 17/26 | |
| 2019/0331235 | A1 * | 10/2019 | Prather | E21B 34/10 | |
| 2022/0136360 | A1 * | 5/2022 | Buckland | E21B 34/06 | 166/192 |

* cited by examiner

FLOW CONTROL SHUTTLE

CROSS-REFERENCE TO RELATED APPLICATIONS

The present application claims priority to and filing benefit of U.S. Provisional Patent Application No. 63/046,572, filed on Jun. 30, 2020, which is incorporated herein by reference in its entirety.

TECHNICAL FIELD

The present disclosure relates to controlling flow of a fluid, gas or mixture in the oil and gas industry.

BACKGROUND

Multiple devices exist for controlling flow during the well completion process in the oil and gas industry. These methods include mechanisms that shear, check valves, plugs that get drilled out, glass plugs or ceramic plugs that are shattered upon actuation, balls that get dropped to close flow paths, and other mechanisms. Many of these designs require additional tools to be run down from the surface to actuate. These designs may require large volumes of fluid and significant time to operate the mechanism. Mechanisms may require a low-pressure differential across a blocked flow path, or to achieve a high capacity for pressure differential, an even higher-pressure differential would be required for actuation. Some of the options such as the glass and ceramics plugs produce unwanted material in the well bore or tubulars as a byproduct.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Described herein is a flow control shuttle, comprising: a body; a shear pin; and a locking pin, wherein the body is configured to secure the shear pin and the locking pin during material flow. In some cases, the flow control shuttle comprises a plurality of locking pins. In certain aspects, the body is configured to operate within a flow control housing, wherein the flow control housing is configured to engage a material flow plug (e.g., the flow control housing is configured to engage an oil extraction component, e.g., a frac plug).

Also described herein is a flow control device, comprising: a housing; a flow control shuttle, comprising: a body; a shear pin; and a locking pin, wherein the body is configured to secure the shear pin and the locking pin during material flow. In some cases, the flow control shuttle comprises a plurality of locking pins, and the body of the flow control shuttle is configured to operate within the housing. In some examples, the housing is configured to engage a material flow plug (e.g., the flow control housing is configured to engage an oil extraction component, e.g., a frac plug).

Also described herein is a method of controlling a flow according to any preceding or subsequent illustration, comprising: deploying a flow control shuttle into a housing; deploying the housing into a material flow channel; and allowing a material to flow through the material flow channel, wherein the material flow actuates the flow control shuttle from a closed position to an open position, and wherein the flow control shuttle does not release contaminants into the material flow. In certain aspects, the method includes maintaining actuary elements within the flow control shuttle. In some examples, maintaining actuary elements within the flow control shuttle comprises employing spring-loaded elements. Optionally, employing spring-loaded elements comprises employing spring-loaded locking pins configured to maintain the flow control shuttle within the housing during a material flow. In certain embodiments, maintaining the flow control shuttle within the housing during material flow comprises prohibiting any aspect of the flow control shuttle from entering the material flow. Accordingly, prohibiting any aspect of the flow control shuttle from entering the material flow comprises keeping the material flow devoid of contaminants. In certain cases, keeping the material flow devoid of contaminants comprises keeping an oil flow free of contaminants.

BRIEF DESCRIPTION OF THE DRAWINGS

The specification makes reference to the following appended figures, in which use of like reference numerals in different figures is intended to illustrate like or analogous components.

DETAILED DESCRIPTION

Certain aspects and features of the present disclosure relate to safely and cleanly controlling a pressurized material flow. In some cases, certain aspects and features of the present disclosure relate to controlling petroleum (e.g., oil) flow in a drilling operation. The embodiments of the present disclosure described below are not intended to be exhaustive or to limit the disclosure to the precise forms described herein. Rather, the embodiments described herein are chosen so that a person of skill in the art can appreciate and understand the principles and practices of the present disclosure.

As used herein, directional and spatial terms such as "horizontal," "vertical," "horizontally," "vertically," and "upward" are not intended to be binding terms.

Figure 1:
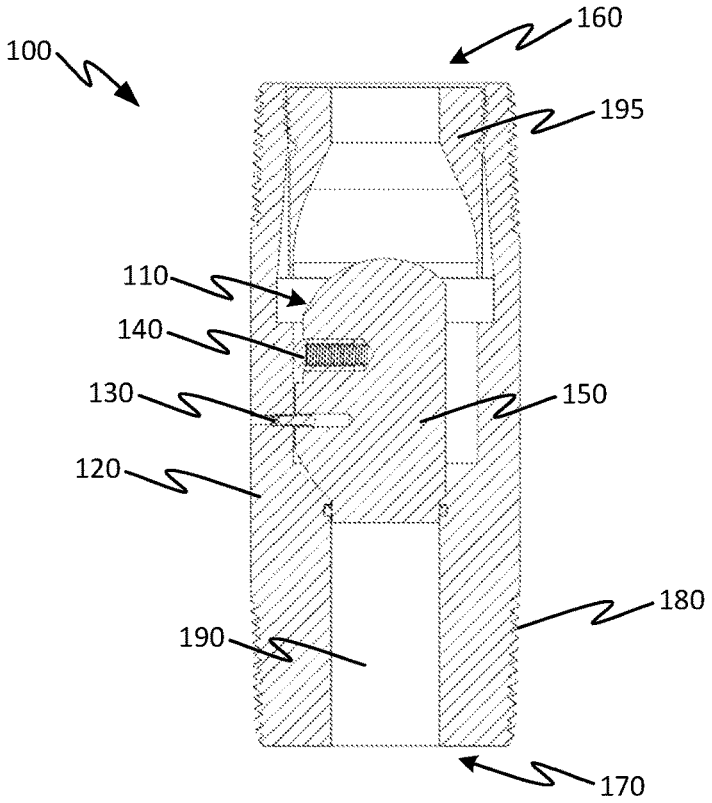
FIG. 1 is a cross-sectional view of a flow control device in a closed position according to certain aspects of the present disclosure.

A representative embodiment is presented in FIG. 1. In some embodiments, a flow control device 100 can be used to control fluid flow in a pressurized system. The flow control device 100 can include a flow control shuttle 110. In the example of FIG. 1, the flow control shuttle 110 is seated in a housing 120 in a closed position, blocking flow in both directions (e.g., flow up and flow down as depicted in FIG. 1). The flow control shuttle 110 is supported by the housing 120 in one direction. The flow control shuttle 110 is supported in the opposite direction by a shear pin 130. Optionally, the flow control shuttle 110 can be supported by a shear ring (not shown) instead of a shear pin 130. The flow control shuttle 110 includes locking pins 140 in an unlocked configuration. The locking pins 140 enable the flow control shuttle 110 to be locked in an open position after activation. In the example of FIG. 1, the locking pins 140 are a spring-loaded locking mechanism contained within a body 150 of the flow control shuttle 110. In the example of FIG. 1, the flow control device 100 includes a high pressure rated side 160 and an activation side 170. In certain embodiments, the flow control device 100 includes pipe threads 180 for deployment in a material flow system. Material flows through the channel 190 passing through the housing 120. A shuttle plug 195 secures the flow control shuttle 110 within the flow control device 100. The shuttle plug 195 is configured to allow the flow control shuttle 110 to actuate from a closed position to an open position.

Figure 2:
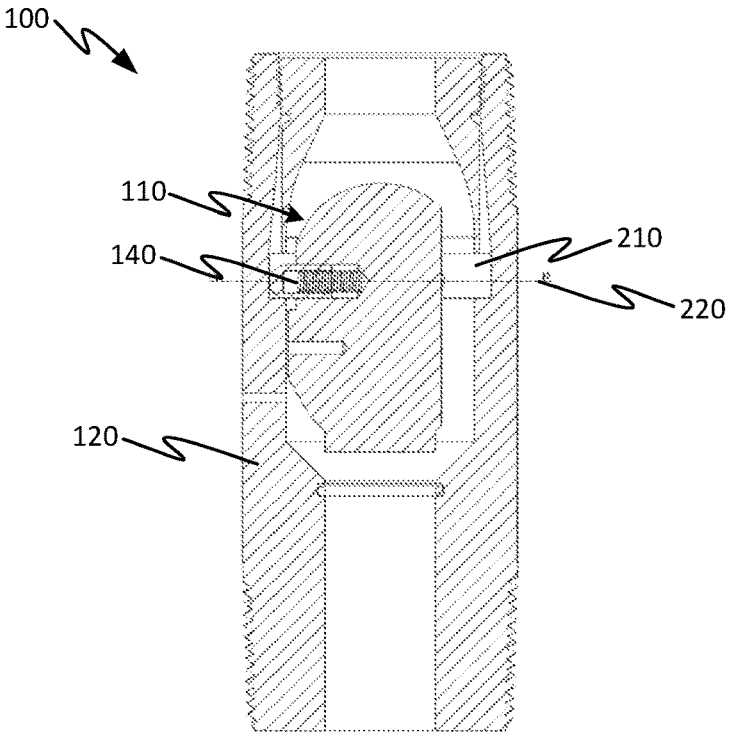
FIG. 2 is a cross-sectional view of a flow control device in an open position according to certain aspects of the present disclosure.
Figure 3:
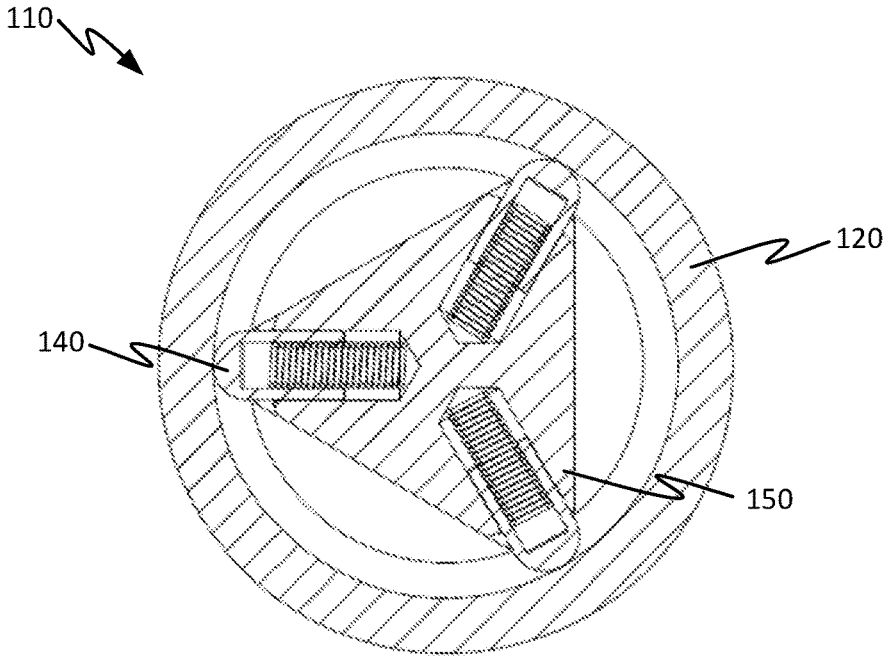
FIG. 3 is a cross-sectional view of a top of a flow control device in an open position according to certain aspects of the present disclosure.

FIG. 2 is a representative embodiment of the flow control device 100 with the flow control shuttle 110 in an open position. Notably in FIG. 1, there shear pin 130 (see FIG. 1) is removed and the flow control shuttle 110 is moved upward by the material flow. Locking pins 140 engaged a recess 210 within the housing 120 to maintain the flow control shuttle 110 in the open position. Line 220 indicates the cross-sectional view shown in FIG. 3. As shown in FIG. 3, the flow control shuttle 110 includes the locking pins 140 contained within the body 150 of the flow control shuttle 110. In the example of FIG. 3, the locking pins 140 are in a locked position such that the flow control shuttle 110 is locked in the open position of FIG. 2.

Figure 4:
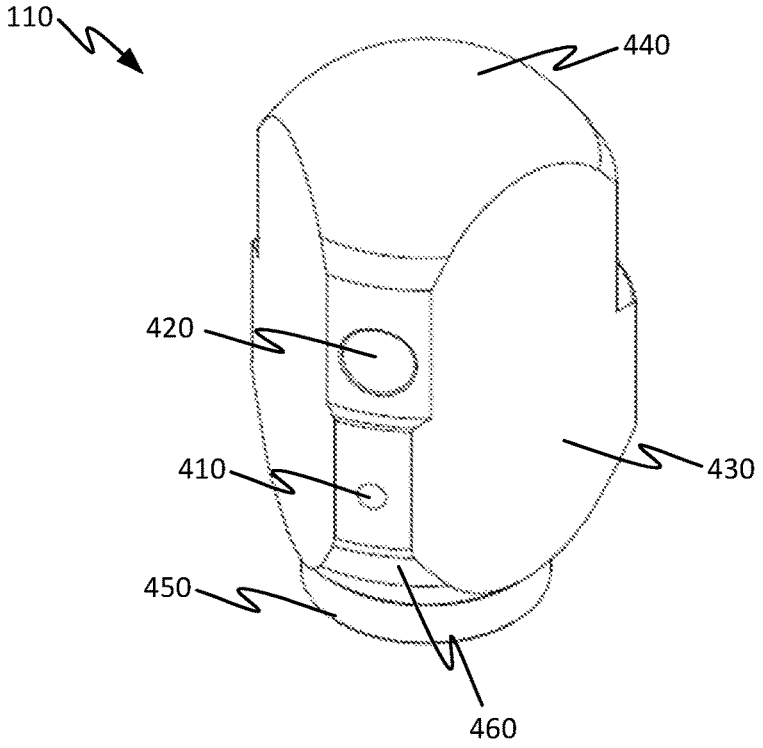
FIG. 4 is a front top perspective view of a flow control shuttle according to certain aspects of the present disclosure.

FIG. 4 depicts the flow control shuttle 110. In the example of FIG. 4, the flow control shuttle 110 includes a shear pin hole 410, a plurality of a locking pin hole 420, a plurality of a flat 430, a domed top 440, and a collar 450 and round bottom 460 configured to mate with the channel 190 (see FIG. 1) and block material flow when in the closed position.

Figure 5:
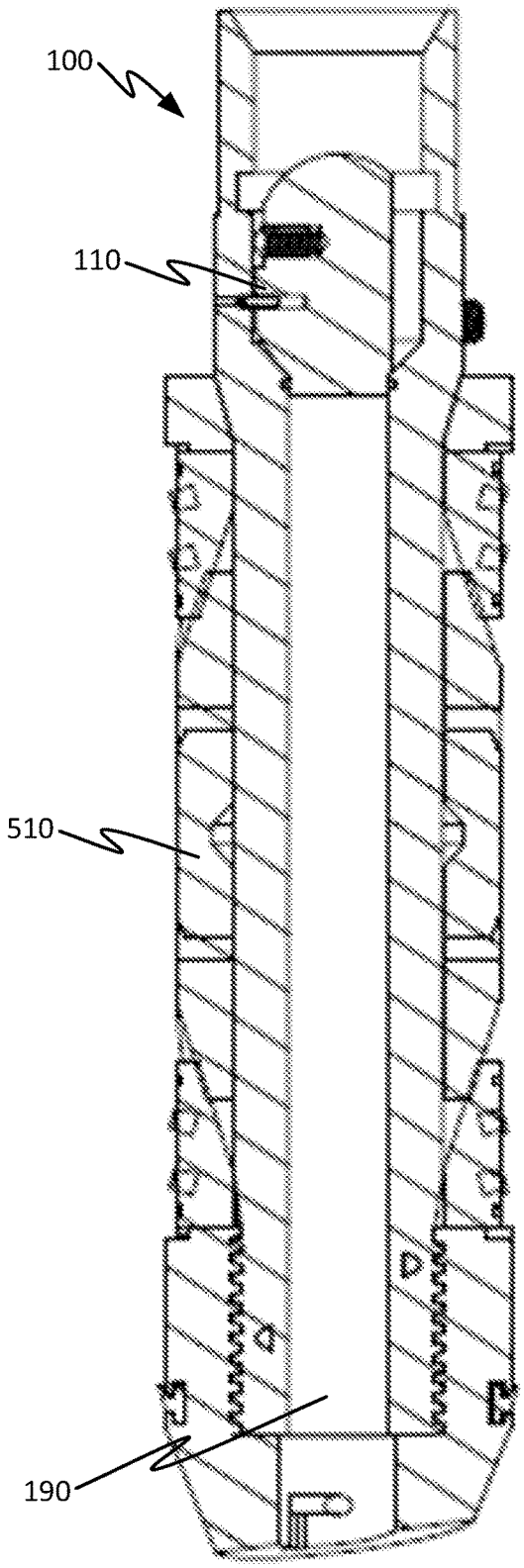
FIG. 5 is a cross-sectional view of a flow control device according to an embodiment described herein.
Figure 6:
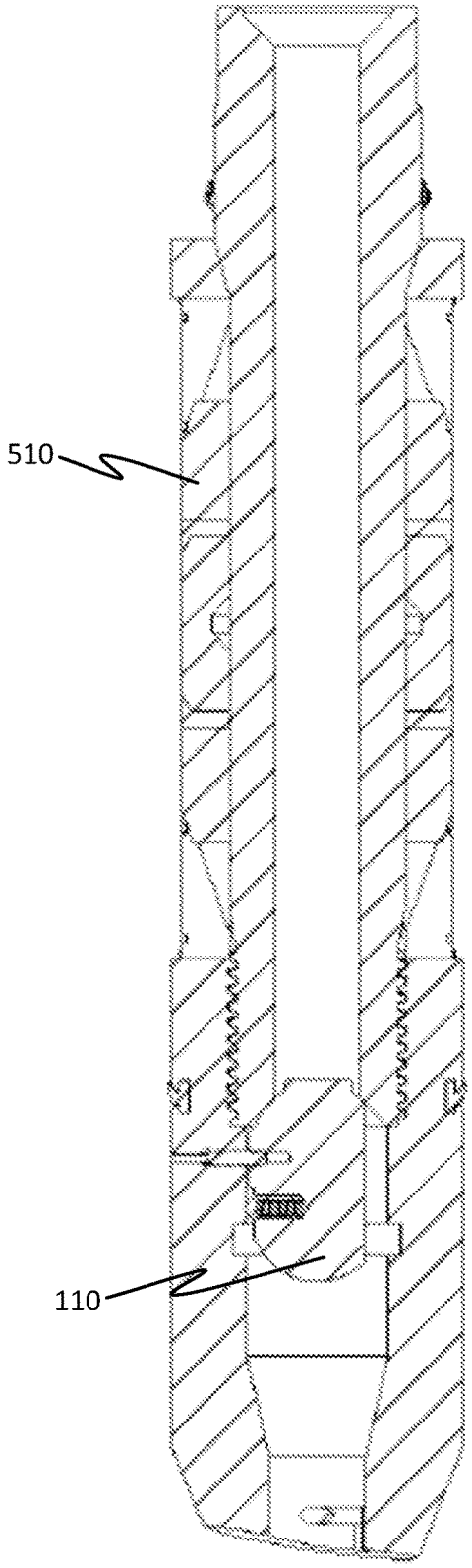
FIG. 6 is a cross-sectional view of a flow control device according to an embodiment described herein.

FIG. 5 is a cross-sectional view of an embodiment showing the flow control device 100 in the closed position deployed in a frac plug 510. The flow control device 100 can be threaded into the frac plug 510 such that oil flowing upward through the frac plug 510 can be controlled by the flow control device 100. In the example of FIG. 5, oil flows from the frac plug into the channel 190 of the flow control device 100 before reaching the flow control shuttle 110. FIG. 6 shows an optional configuration of FIG. 5, wherein the flow control device 100 is configured to control the oil flow before the oil flows through the channel 190 of the flow control device 100 when employed in a frac plug 510.

Figure 7:
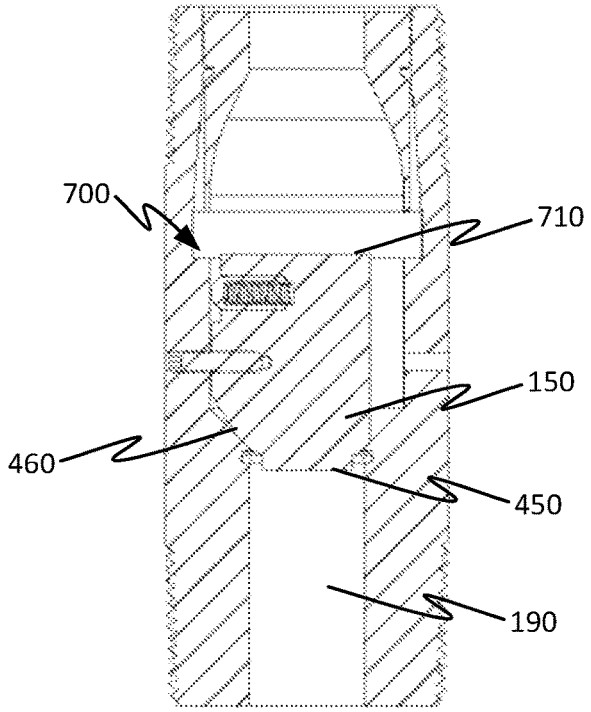
FIG. 7 is a cross-sectional view of a flow control device according to an embodiment described herein.

In certain embodiments, the flow control shuttle 110 is a flat top flow control shuttle 700, having a flat top 710. As shown in FIG. 7, the flat top flow control shuttle 700 includes the body 150 having the collar 450 and round bottom 460 configured to mate into the channel 190 to control material flow.

Figure 8:
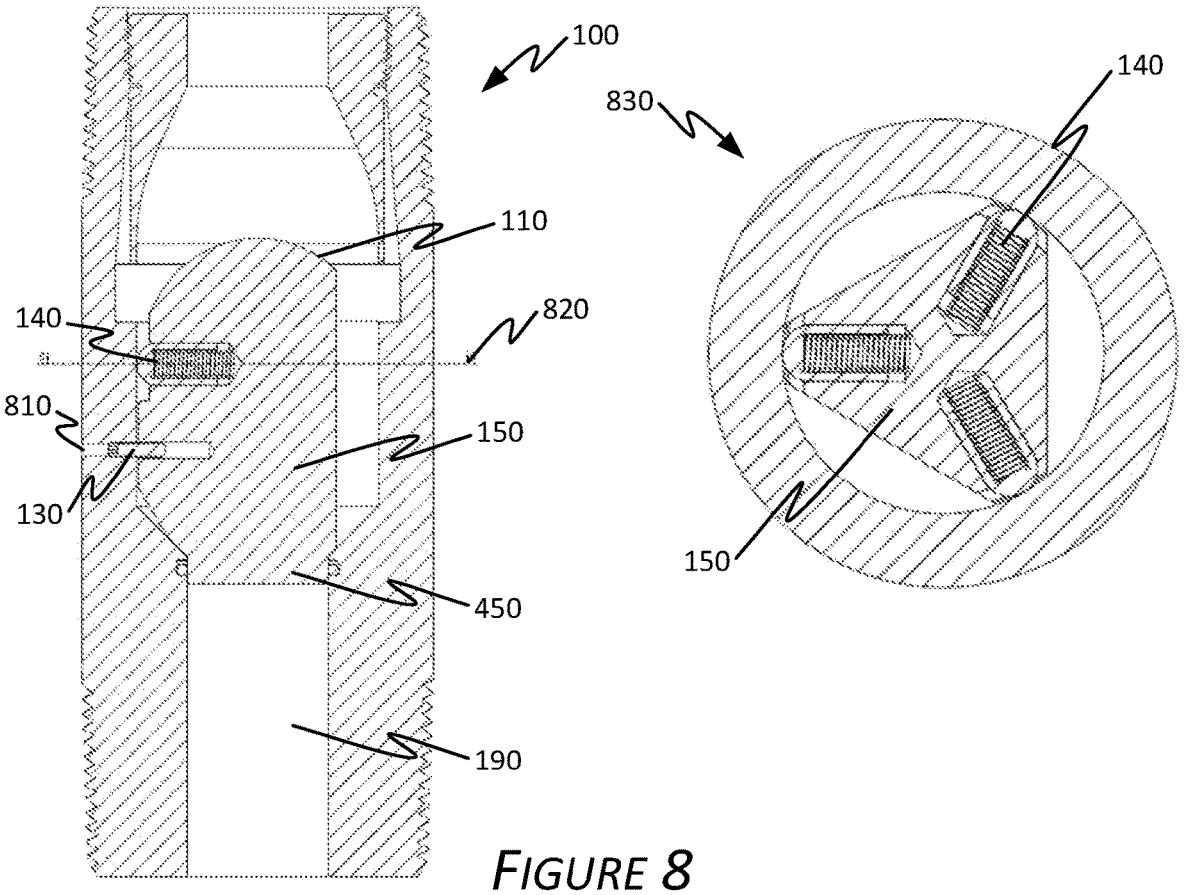
FIG. 8 shows cross-sectional views of a flow control device in a closed position according to an embodiment described herein.
Figure 9:
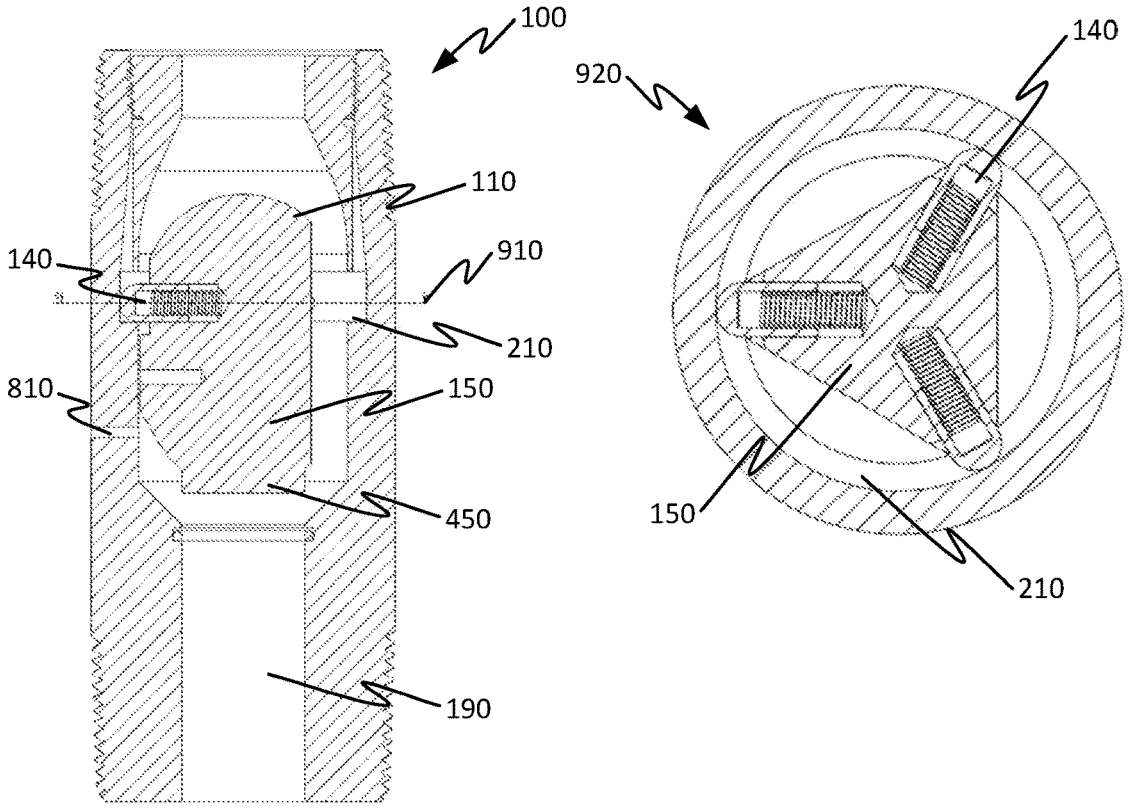
FIG. 9 shows cross-sectional views of a flow control device in an open position according to an embodiment described herein.

FIGS. 8 and 9 demonstrate the flow control device 100 having the flow control shuttle 110 in a closed position (FIG. 8) and an open position (FIG. 9). As shown in FIG. 8, the flow control shuttle 110 includes the shear pin 130 engaged in a shear pin receptor 810. The locking pin 140 is compressed into the body 150 of the flow control shuttle 110. The collar 450 is seated in the channel 190 blocking material flow. A line 820 shows the location of cross-section 830. Cross-section 830 shows the locking pins 140 compressed within the body 150 of the flow control shuttle 110. FIG. 9 shows the flow control device 100 having the flow control shuttle 110 in an open position. Notably, the shear pin (not shown in FIG. 9) is removed allowing the material flow through the channel 190 to push the flow control shuttle 110 into the open position wherein the collar 450 is disengaged from the channel 190. Locking pins 140 engage the recess 210 to maintain the flow control shuttle 110 in the open position. A line 910 shows the location of cross-section 920. Cross-section 920 shows the locking pins 140 extended out of the body 150 of the flow control shuttle 110 and into the recess 210.

Figure 10:
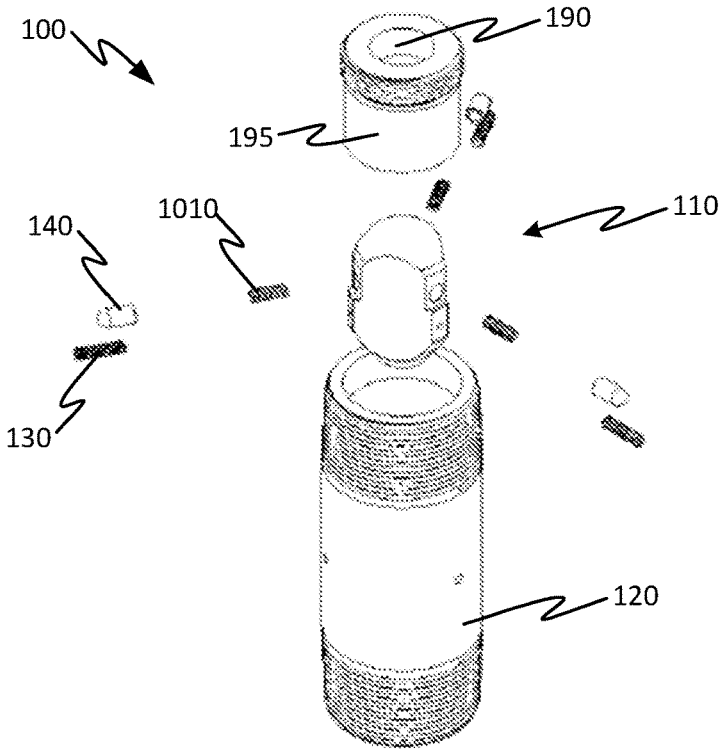
FIG. 10 is an exploded view of a flow control device according to certain aspects of the present disclosure.

FIG. 10 is an exploded view of the flow control device 100 and the flow control shuttle 110. In the example of FIG. 10, the flow control shuttle 110 includes a plurality of shear pins 130, a plurality of locking pins 140 and locking pin springs 1010. The housing 120 includes the channel 190 and the shuttle plug 195.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

Figure 11:
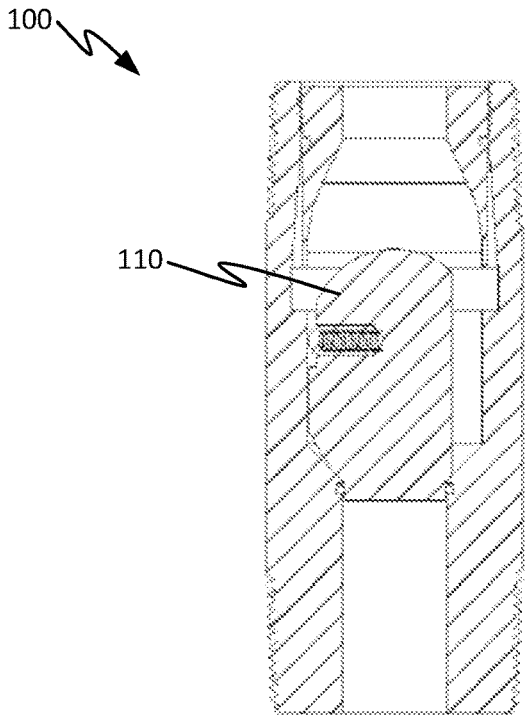
FIG. 11 is a cross-sectional view of a flow control device according to an embodiment described herein.
Figure 12:
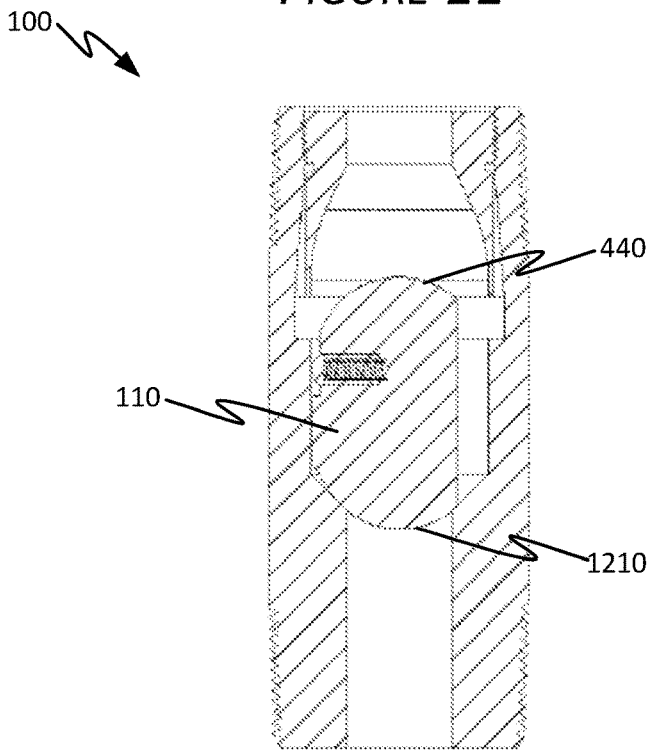
FIG. 12 is a cross-sectional view of a flow control device according to an embodiment described herein.
Figure 13:
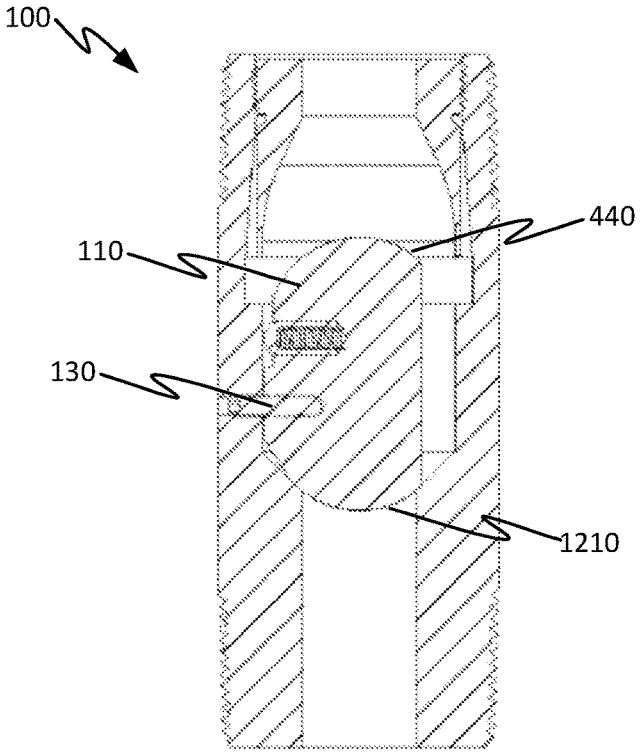
FIG. 13 is a cross-sectional view of a flow control device according to an embodiment described herein.
Figure 14:
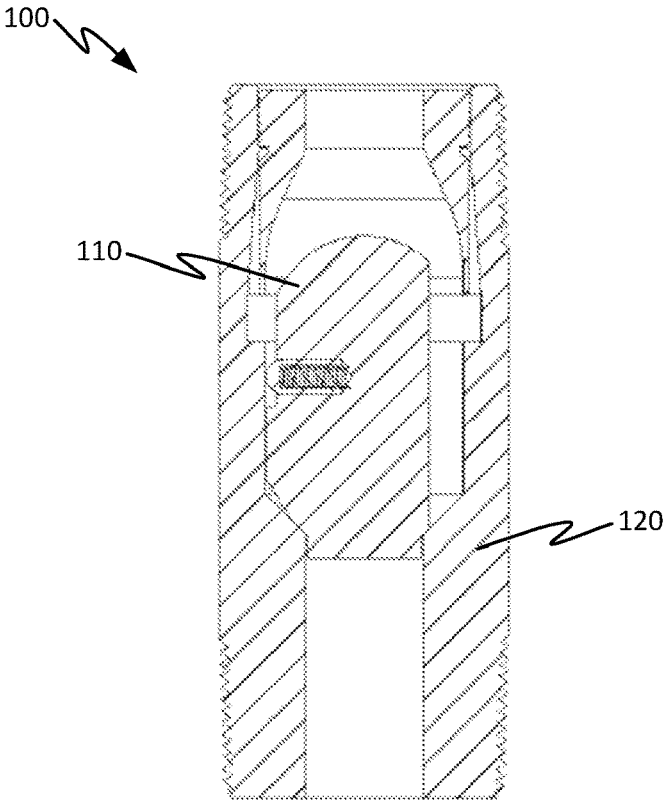
FIG. 14 is a cross-sectional view of a flow control device according to an embodiment described herein.

Further embodiments of the present invention include a flow control device 100 wherein the flow control shuttle 110 can be operated without a shear pin 130 (see FIG. 1), as shown in FIG. 11. Optionally, the flow control shuttle 110 can be provided having a domed bottom 1210 as well as a domed top 440 (see FIG. 4) as in the example of FIG. 12. In certain embodiments, the flow control shuttle can include a domed bottom 1210 and a shear pin 130, as shown in FIG. 13. Optionally, a flow control device 100 can include a flow control shuttle 110 held in a closed position by friction, as in the example of FIG. 14. Shown in FIG. 14, the flow control shuttle 110 can be operated without a shear pin (not shown) wherein the flow control shuttle 110 is placed in the closed position with sufficient placement pressure to allow friction between the flow control shuttle 110 and the housing 120 to maintain the flow control shuttle 110 in the closed position until the flow control shuttle 110 is actuated into an open position.

Figure 15:
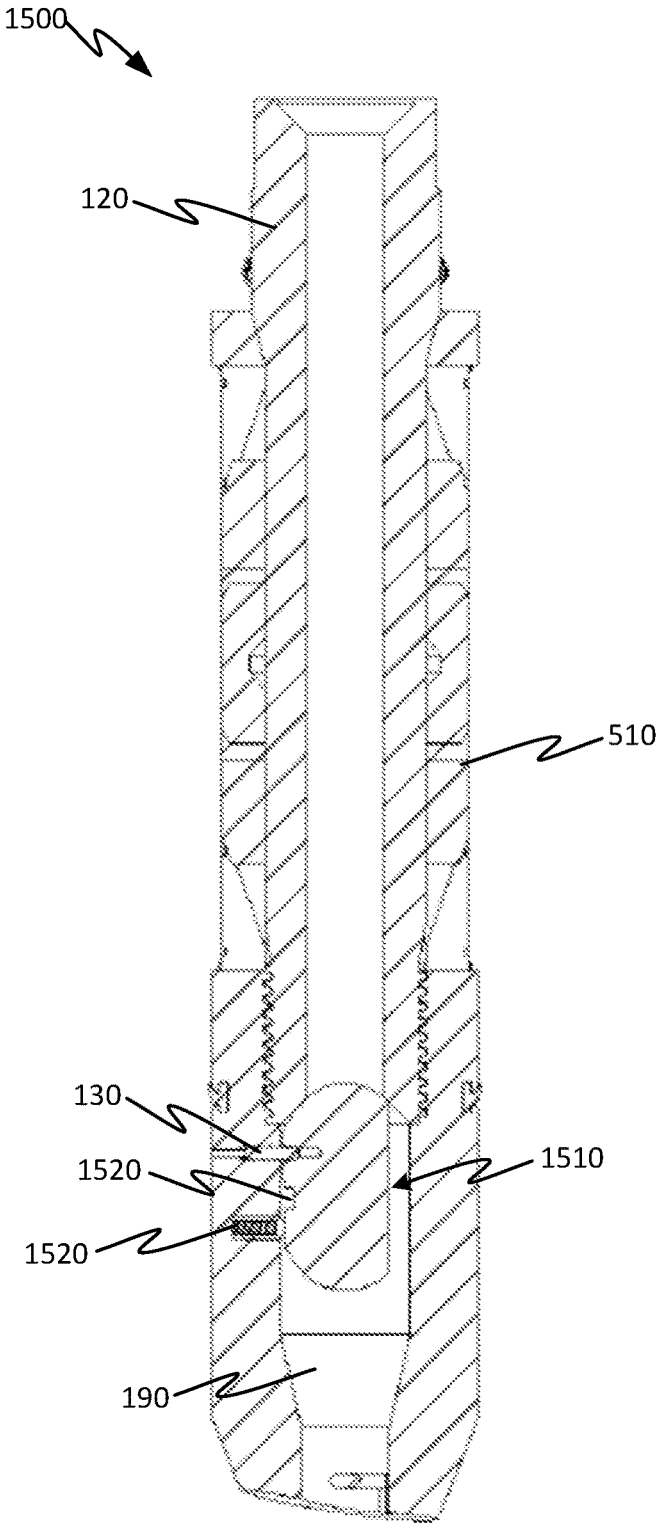
FIG. 15 is a cross-sectional view of a flow control device according to an embodiment described herein.
Figure 16:
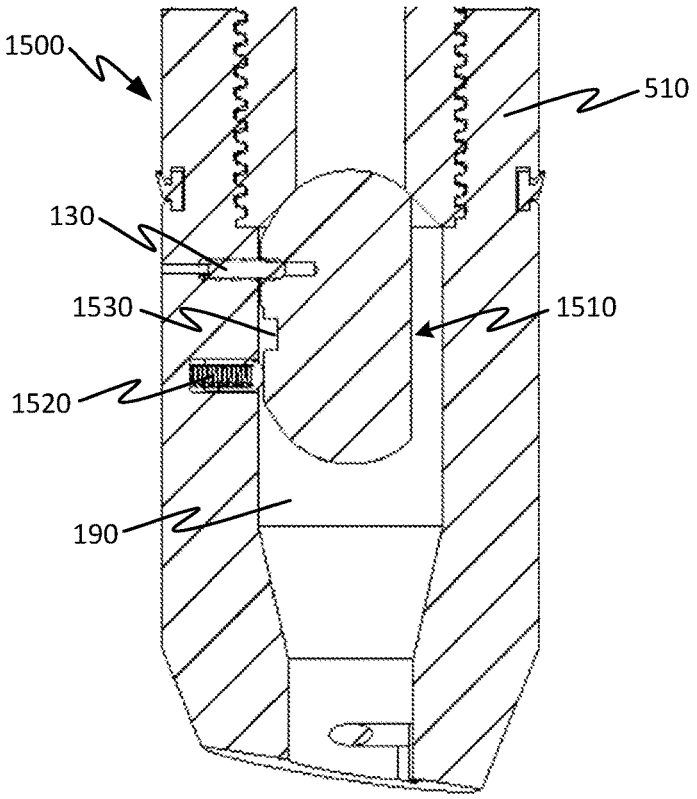
FIG. 16 is a cross-sectional view of a flow control device according to an embodiment described herein.

In certain embodiments, a flow control system can have the configuration depicted in FIG. 15. In the example of FIG. 15, the flow control device 1500 is threaded into a frac plug 510. The flow control shuttle 1510 is secured in place by the housing 120. The shear pin 130 maintains the flow control shuttle 1510 in a closed position. Locking pins 1520 are positioned within the frac plug 510 to engage a flow control shuttle detent 1530 when the flow control shuttle 1510 is actuated into an open position. FIG. 16 is a magnified image from FIG. 15 showing the flow control shuttle 1510 in greater detail.

Figure 17:
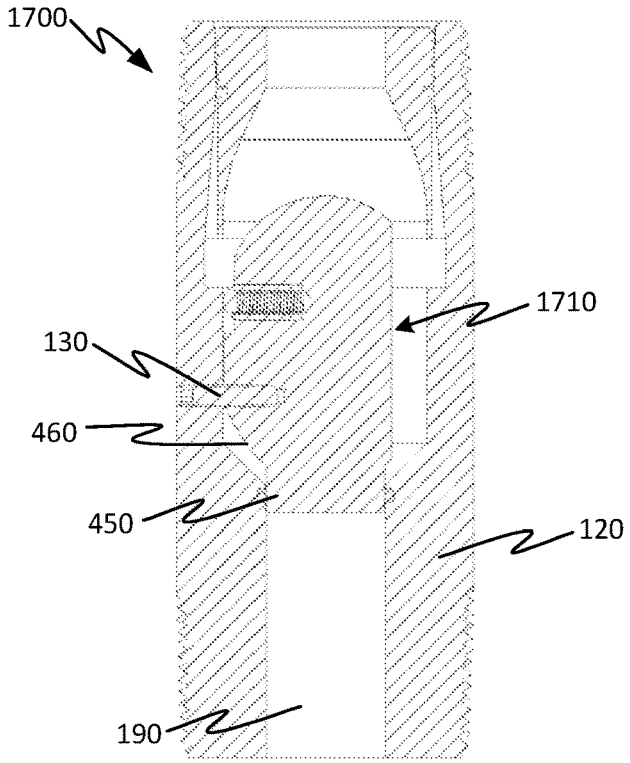
FIG. 17 is a cross-sectional view of a flow control device according to an embodiment described herein.
Figure 18:
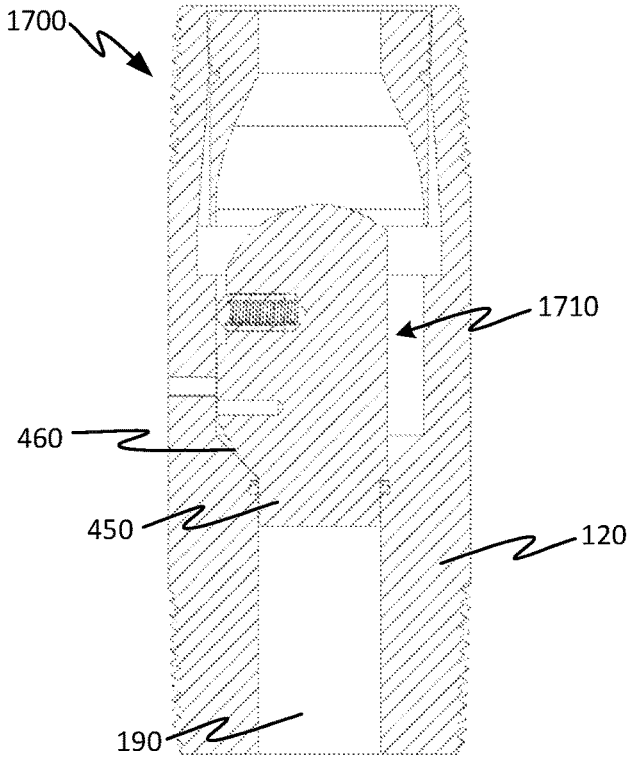
FIG. 18 is a cross-sectional view of a flow control device according to an embodiment described herein.
Figure 19:
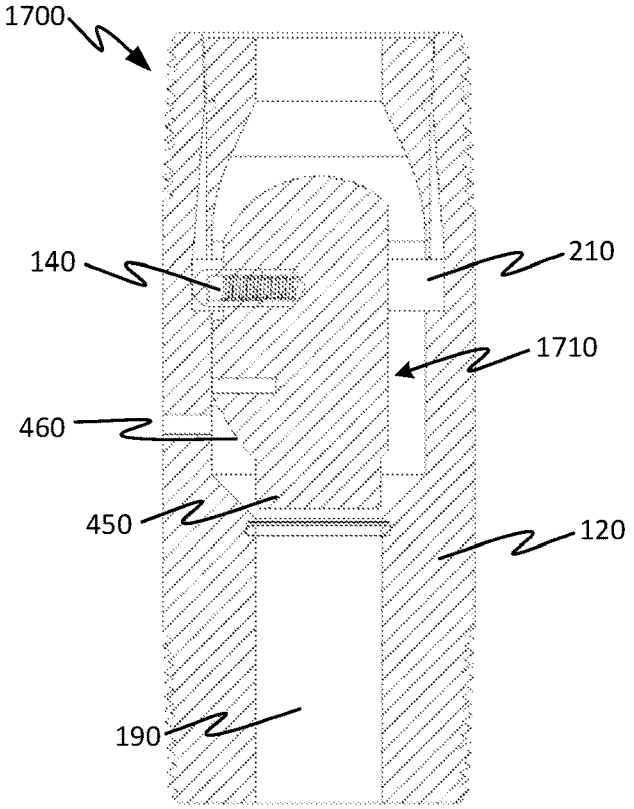
FIG. 19 is a cross-sectional view of a flow control device according to an embodiment described herein.

Still further embodiments of the present invention are shown in FIGS. 17-19. In the example of FIG. 17, a flow control device 1700 can be configured to be held in a partially closed position when a shear pin 130 is engaged with the flow control shuttle 1710. As shown in FIG. 17, the collar 450 is seated in the channel 190. The round bottom 460 is maintained at a position adjacent to but not contacting the housing 120. In the example of FIG. 18, the shear pin (not shown) is removed and the flow control shuttle 1710 is in a fully closed position. The collar 450 is further seated in the channel 190 when compared to the example of FIG. 17, and the round bottom 460 is contacting the housing 120. In the example of FIG. 19, the flow control shuttle 1710 is in a fully open position, wherein the locking pins 140 engage the recess 210 of the housing 120. The collar 450 and round bottom 460 are disengaged from the channel 190, allowing material to flow through the housing 120.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

Illustrations of Preferred Embodiments

Illustration 1 is a flow control shuttle, comprising: a body; a shear pin; and a locking pin, wherein the body is configured to secure the shear pin and the locking pin during material flow.

Illustration 2 is the flow control shuttle of any preceding or subsequent illustration, comprising a plurality of locking pins.

Illustration 3 is the flow control shuttle of any preceding or subsequent illustration, wherein the body is configured to operate within a flow control housing.

Illustration 4 is the flow control shuttle of any preceding or subsequent illustration, wherein the flow control housing is configured to engage a material flow plug.

Illustration 5 is the flow control shuttle of any preceding or subsequent illustration, wherein the flow control housing is configured to engage an oil extraction component.

Illustration 6 is the flow control shuttle of any preceding or subsequent illustration, wherein the flow control housing is configured to engage a frac plug.

Illustration 7 is a flow control device according to any preceding or subsequent illustration, comprising: a housing; a flow control shuttle, comprising: a body; a shear pin; and a locking pin, wherein the body is configured to secure the shear pin and the locking pin during material flow.

Illustration 8 is the flow control device of any preceding or subsequent illustration, wherein the flow control shuttle comprises a plurality of locking pins.

Illustration 9 is the flow control device of any preceding or subsequent illustration, wherein the body of the flow control shuttle is configured to operate within the housing.

Illustration 10 is the flow control device of any preceding or subsequent illustration, wherein the housing is configured to engage a material flow plug.

Illustration 11 is the flow control device of any preceding or subsequent illustration, wherein the housing is configured to engage an oil extraction component.

Illustration 12 is the flow control device of any preceding or subsequent illustration, wherein the flow control housing is configured to engage a frac plug.

Illustration 13 is a method of controlling a flow according to any preceding or subsequent illustration, comprising: deploying a flow control shuttle into a housing; deploying the housing into a material flow channel; and allowing a material to flow through the material flow channel, wherein the material flow actuates the flow control shuttle from a closed position to an open position, and wherein the flow control shuttle does not release contaminants into the material flow.

Illustration 14 is the method of any preceding or subsequent illustration, comprising maintaining actuary elements within the flow control shuttle.

Illustration 15 is the method of any preceding or subsequent illustration, wherein maintaining actuary elements within the flow control shuttle comprises employing spring-loaded elements.

Illustration 16 is the method of any preceding or subsequent illustration, wherein employing spring-loaded elements comprises employing spring-loaded locking pins configured to maintain the flow control shuttle within the housing during a material flow.

Illustration 17 is the method of any preceding or subsequent illustration, wherein maintaining the flow control shuttle within the housing during material flow comprises prohibiting any aspect of the flow control shuttle from entering the material flow.

Illustration 18 is the method of any preceding or subsequent illustration, wherein prohibiting any aspect of the flow control shuttle from entering the material flow comprises keeping the material flow devoid of contaminants.

Illustration 19 is the method of any preceding or illustration, wherein keeping the material flow devoid of contaminants comprises keeping an oil flow free of contaminants.

What is claimed is:

1. A flow control shuttle, comprising:

a body configured to selectively block material flow along a flow path;

a shear pin configured to engage the body; and a locking pin configured to engage the body, wherein at least one of the shear pin or the locking pin is configured to secure the body during material flow, wherein the body comprises a first flat side and a second flat side arranged at an angle relative to the first flat side, and wherein the locking pin and shear pin are at an intersection of the first flat side and the second flat side.

2. The flow control shuttle of claim 1, wherein the locking pin is a first locking pin of a plurality of locking pins.

3. The flow control shuttle of claim 1, wherein the body is configured to operate within a flow control housing.

4. A flow control device comprising the flow control shuttle of claim 3 and the flow control housing, wherein the flow control shuttle is movable between a closed position and an open position within the flow control housing, wherein, in the closed position, the flow control shuttle blocks material flow along the flow path through the housing, and wherein the flow control housing is configured to engage at least one of a material flow plug, an oil extraction component, or a frac plug.

5. The flow control shuttle of claim 1, wherein the body comprises a top end and a bottom end opposite from the top end, wherein the bottom end comprises a collar configured to obstruct a channel of a flow control device.

6. A flow control device, comprising:

a housing;

a flow control shuttle, comprising:

a body configured to selectively block material flow through the housing;

a shear pin configured to engage the body; and a locking pin configured to engage the body, wherein at least one of the shear pin or the locking pin is configured to secure the body during material flow through the housing, wherein the body comprises a first flat side and a second flat side arranged at an angle relative to the first flat side, and wherein the locking pin and shear pin are at an intersection of the first flat side and the second flat side.

7. The flow control device of claim 6, wherein locking pin of the flow control shuttle is a first locking pin of a plurality of locking pins.

8. The flow control device of claim 6, wherein the body of the flow control shuttle is movable within the housing between a closed position and an open position.

9. The flow control device of claim 6, wherein the housing is configured to engage at least one of a material flow plug, an oil extraction component, or a frac plug.

10. The flow control device of claim 6, wherein the body comprises a top end and a bottom end opposite from the top end, wherein the housing defines a channel, and wherein the bottom end of the body comprises a collar configured to obstruct the channel in a closed position of the flow control shuttle.

* * * * *